United States Patent [19]

Wang

[11] Patent Number: 4,749,369

[45] Date of Patent: Jun. 7, 1988

[54] CONNECTOR

[76] Inventor: Shun H. Wang, RM. 807 No.3, Lane 990, Min Sheng E. Rd., Taipei, Taiwan

[21] Appl. No.: 25,727

[22] Filed: Mar. 13, 1987

[51] Int. Cl.[4] ..... H01R 13/506

[52] U.S. Cl. ..... 439/459; 439/460; 439/725; 439/731

[58] Field of Search ..... 439/449, 459, 460, 465, 439/469, 472, 725, 731, 752

[56] References Cited

U.S. PATENT DOCUMENTS

| | | | |
|---|---|---|---|
| 4,117,998 | 10/1978 | Notoya | 439/459 |
| 4,130,330 | 12/1978 | Chandler | 439/358 |
| 4,367,005 | 1/1983 | Douty et al. | 439/459 |
| 4,549,780 | 10/1985 | Bertini et al. | 439/465 |
| 4,561,715 | 12/1985 | Sanchez | 439/449 |
| 4,632,489 | 12/1986 | Skinner | 439/459 |

*Primary Examiner*—John McQuade

*Attorney, Agent, or Firm*—Browdy and Neimark

[57] ABSTRACT

An improved connector mainly comprising an upper case body, a lower case body, a sliding clip and a conventional plug, a plurality of pairs of male and female fastener elements extended from the upper and lower case bodies at respective corresponding positions, each male fastener element having an extension in the form of a strip and each female fastener element having a recess corresponding to the strip for assembly of the upper and lower case bodies. Each of the case bodies has a transverse slot at the rear end, and each transverse slot has a row of teeth sloping in a certain direction. The sliding clip has a row of teeth on the upper side and another row of teeth on the lower side, each corresponding to the teeth of a transverse slot, with the sliding clip having an opening at one end for holding a cable within the transverse slots and by engagement between the teeth on the sliding clip and the teeth on the transverse slots, cables of different diameter can be positioned therein.

3 Claims, 2 Drawing Sheets

CONNECTOR

BACKGROUND OF THE INVENTION

The present invention relates to a connector, particularly an improvement for a case body of a connector to simplify its assembly.

Generally, the conventional connector comprises, as shown in FIG. 1, an upper case body 11, a lower case body 12, a plug 13 and two fixing plates 14A, 14B. About a dozen cords 151 have to be soldered to their respective connection pins 131 on the plug 13 and then held against a pull on cord 15 in their appropriate position by screws 141 prior to assembly of the connector. For assembly of the connector, the plug 13 has to be positioned on a slot 16 at the front ends of the upper and lower case bodies 11 and 12, and then it is fixed therein with the fixing plate 14 with a plurality of screws 18 and nuts 19 which, in turn, also firmly connect the upper and lower case bodies together.

The conventional connector 10 requires the use of fixing plate 14 and screws 141 to position and relieve strain on cable 15. Assembly of the connector is thus inconvenient. Furthermore, a screw drive is also required to screw the screws 18 and nuts 19 for assembling of the upper and lower case bodies.

SUMMARY OF THE INVENTION

The main objective of the present ivnention is to provide a connector which can position cable in a simple way, and can fix cable of different diameters.

Another objective of the present invention is to provide a connector which can have its upper and lower case bodies connected together without the use of any screws.

The structure, function, and other features of the present invention are described below with reference to the attached drawings.

DETAILED DESCRIPTION OF THE PREFERRED EMBODIMENT

Figure 1:
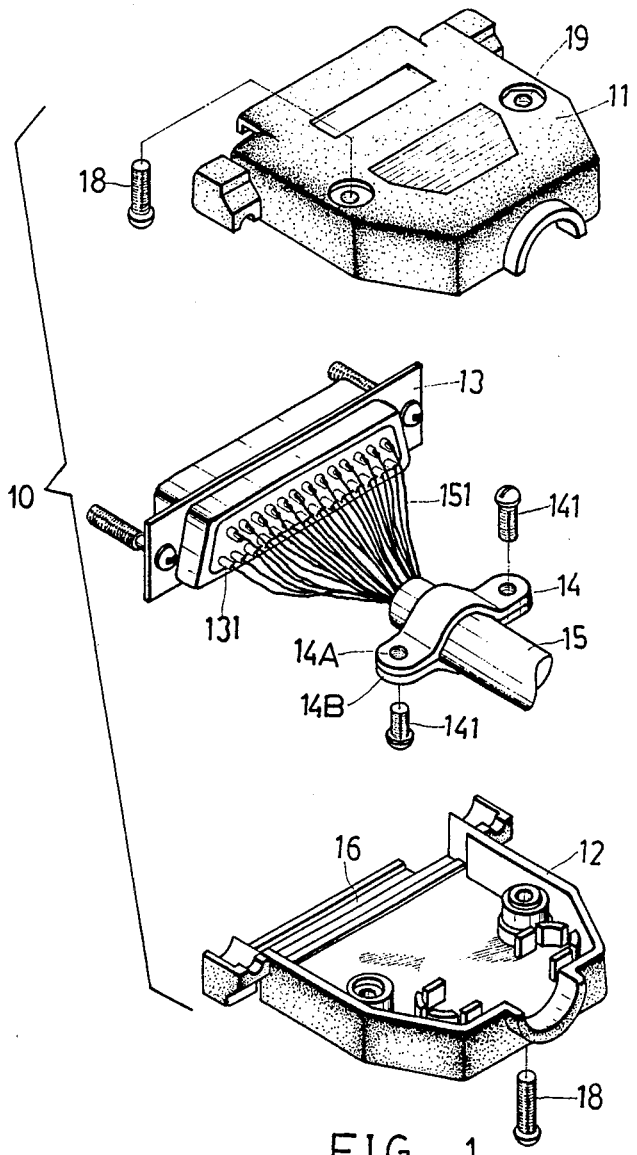
FIG. 1 PRIOR ART
FIG. 1 is a fragmental and perspective view of a prior art connector.
Figure 2:
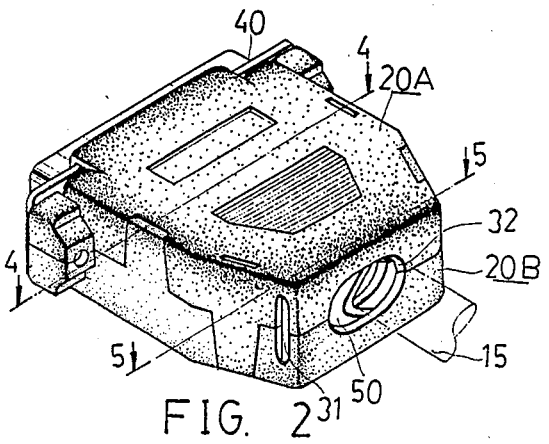
FIG. 2 is a perspective view of an embodiment according to the present invention.
Figure 3:
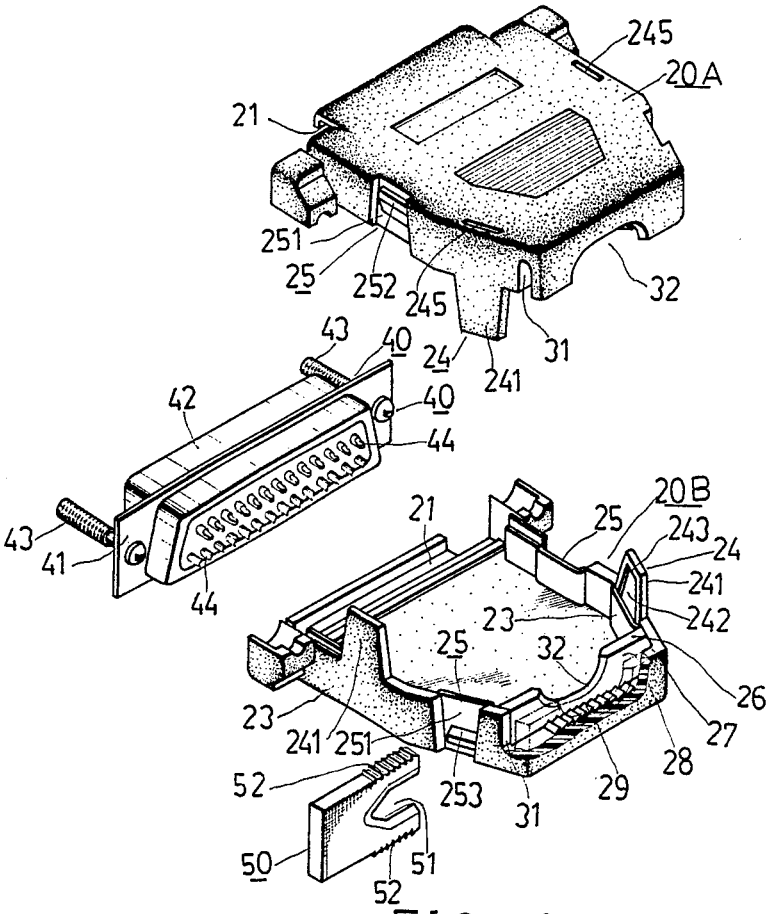
FIG. 3 is a fragmental perspective view of the connector shown in FIG. 2.

As shown in FIGS. 2 and 3, the connector according to the present invention mainly comprises an upper case body 20A, a lower case body 20B, a plug 40 and a sliding clip 50.

The upper case body 20A and the lower case body 20B are of the same structure, and therefore their parts which are similar will be described by the same reference number 20 (referring to both 20A and 20B) in the text hereinafter. Each case body has a transverse slot 21 on the inner side of its front edge, and four male fastener elements 24 of the same structure and four female fastener elements 25 of the same structure around its inner edge. The male fastener element 24 comprises a fastening element 241 extending from wall 23 of the case body 20 with an appropriate recess 242 and a side ridge 243.

The female fastener element 25 has a recession 251 and a stopping block 252. The recess 251 is complementary to the fastening element 241 of the male fastener element 24. That is, the fastening element 241 can be tightly fixed within the recess 251. The stopping block 252 is a block on the recess 251 and has an appropriate slope 253. A transverse slot 28 is formed between ribs 26 and 27 at the rear side of the upper and lower case bodies 20. On the bottom of the transverse slot 28 there is a row of teeth 29 sloping outward in each case body 20 in the same direction and toward a vertical elongated opening 31 at a side. There is a long curvy or oblong hole 32 through the ribs 26 and 27.

The plug 40 is a conventional element including a fixing board 41 and a body 42. The fixing board 41 is to fix the connector to the socket by means of two screws 43, each at a lateral side. Of course, there are other ways to fix the connector instead of screws. The body 42 has two rows of pins 44 for connecting to electric cords.

The sliding clip 50 is an element in the form of a plate. It has a V-opening 51 at one end, and a row of teeth 52 on the upper side, another row on the lower side complementary to the aforesaid teeth 29. The teeth 52 slope in the same direction as teeth 29.

The above structure permits easy and simple assembly of the connector according to the present invention in the manner described below.

Figure 4:
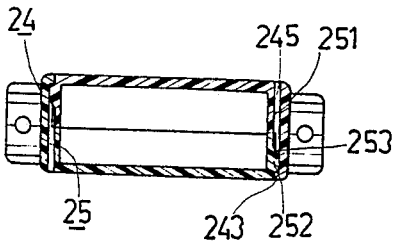
FIG. 4 is a cross sectional view along line 4—4 in FIG. 2.

For assembly of the device of the present invention, the edge of the fixing board 41 on the plug 40 is first inserted in the transverse slot 21 of the lower case body 20B and the sliding clip 50 is placed in the transverse slot 28 near the long hole 31. Then, cable 15 is placed with in the oblong hole 32, and the upper and lower case bodies 20A and 20B are fastened together in a manner that each male fastener element 24 is connected to its corresponding female fastener element 25 as shown in the partial sectional view of FIG. 4; that is, the side ridge 243 of the fastening element 241 is slid over the slope 253 of the recess 251 to seize onto stopping block 252. Connection of these four sets of male fastener elements 24 and female fastener elements 25 causes the upper and lower case bodies 20A and 20B to fix together firmly in the manner as shown in FIG. 4. In brief, the present invention requires only positioning of the plug 40 and the sliding clip 50 and fixing the upper case body 20A to the lower case body 20B to complete assembly of a connector—the first feature of the present invention.

Figure 5:
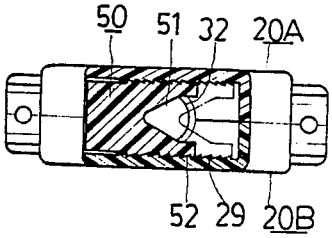
FIG. 5 is a cross sectional view along line 5—5 in FIG. 2.

The cable 15 is placed in the oblong hold 32, where it can be moved and seized by pushing of the sliding clip 50 in the long hole 31, engagement between the teeth 29 and the teeth 52 preventing the cable 15 from backward movement (as shown in FIG. 5). Cables of many different diameters can be kept firmly wedged between the V-opening 51 and the sides of hole 32—another feature of the present invention.

There is a long slot 245 passing through a wall on each of the upper and lower case bodies 20A and 20B at each respective position corresponding to a male fastener element 24 to permit insertion of a tool in the form of a plate into the recess 242 of the fastening element 241 to pull the fastening element 241 to displace outward and to disengage the side ridge from the stopping block 252 for disassembling the upper and lower case bodies 20A and 20B. Such a design assures easy and simple dismantling of the upper and lower case bodies 20A and 20B.

There is another method for assembly of the present invention. The plug 40 and the cable 15 are first placed in the lower case body 20B. The upper case body 20A is then fixed to the lower case body 20B by connection of the four sets of male and female fastener elements 24 and 25, and finally the sliding clip 50 is pushed inward through the long hole 31 to fix the cable 15 firmly by engagement of the teeth 29 and the teeth 52 to complete assembly of the connector according to the present invention.

In conclusion, the connector according to the present invention is characterized by its simplicity on assembly resulting from its simple structure. It comprises an upper case body 20A, a lower case body 20B and a sliding clip 50 with a conventional plug 40, assembly of which requires fixing together of the upper and lower case bodies 20A and 20B and positioning of cable without any screws. It is a design which can contribute to high production efficiency.

I claim:

1. An improved connector comprising an upper case body, a lower case body, a sliding clip and a plug, and characterized by plural pairs of male and female fastener elements extending from the upper case body and the lower case body at respective corresponding positions in the manner that each male fastener element is in the form of a strip with a recess on the inner side and a side ridge along its edges extending from the wall of the case body, and each female fastener element has a recess at the position corresponding to the male fastener element, in a form complementary to the strip and has a sloping portion leading to a stopping block in the recess so that the side ridge of the male fastener element can be slid over said sloping portion and fixed to the stopping block of the female fastener element when the male fastener element is connected to the female fastener element; and a transverse slot on the rear end of the upper case body and another on the rear end of the lower case body, each with a row of teeth on the bottom and a long curvy hole in the middle;

a sliding clip in the form of a plate with a row of teeth sloping in a certain direction on its upper side and another row of teeth sloping in a similar direction on its lower side, and a V-opening in the middle of a lateral side for holding of a cable, designed in a manner that its upper and lower teeth are corresponding to the teeth on the near ends of the upper and lower case bodies to permit sliding in only one direction for that cable to be fixed in the V-opening and the long curvy holes between the rear ends of the upper and lower case bodies.

2. An improved connector as claimed in claim 1 wherein there is a long hole beside the transverse slots of the upper and lower case bodies to permit sliding of the sliding clip therein after fixing the upper case body to the lower case body for holding of a cable.

3. An improved connector as claimed in claim 1 wherein there is a hole passing through the wall of the case bodies at each position corresponding to the strip of each male fastener element of the case bodies for insertion of a tool in the form of a plate to displace the strip for disengaging connection of the fastener elements and then dismantling the upper and lower case bodies.

* * * * *